US006216404B1

(12) United States Patent
Vellrath

(10) Patent No.: US 6,216,404 B1
(45) Date of Patent: Apr. 17, 2001

(54) SLIP JOINT AND HOSE STREAM DEFLECTOR ASSEMBLY

(76) Inventor: Timothy Vellrath, 55 Wilton Rd., Plymouth, CT (US) 06782

( * ) Notice: Subject to any disclaimer, the term of this patent is extended or adjusted under 35 U.S.C. 154(b) by 0 days.

(21) Appl. No.: 09/315,190

(22) Filed: May 19, 1999

Related U.S. Application Data

(60) Provisional application No. 60/105,733, filed on Oct. 26, 1998.

(51) Int. Cl.[7] ..... E04C 2/26

(52) U.S. Cl. ..... 52/232; 52/1; 52/282.1; 52/354; 52/356; 52/573.1; 52/650.1; 52/729.1; 52/729.5; 52/732.3; 52/733.4

(58) Field of Search ..... 52/1, 232, 573.1, 52/726.2, 726.3, 729.1, 729.5, 731.1, 731.5, 732.1, 732.3, 733.2, 733.4, 739.1, 634, 261, 232.1, 650.1, 696, 98, 10, 354, 356

(56) References Cited

U.S. PATENT DOCUMENTS 3,908,328 * 9/1975 Nelsson ..... 52/735
3,940,899 * 3/1976 Balinski ..... 52/481
4,152,873 * 5/1979 Burke ..... 52/1
4,364,212 * 12/1982 Pearson et al. ..... 52/281
4,885,884 * 12/1989 Schilger ..... 52/354
5,088,249 * 2/1992 Marzouki ..... 52/232
5,390,457 * 2/1995 Sjolander ..... 52/387
5,515,660 * 5/1996 Hanks et al. ..... 52/667
5,740,635 * 4/1998 Gil et al. ..... 52/79.1
5,921,041 * 7/1999 Egri, II ..... 52/241
6,003,274 * 12/1999 Wycech ..... 52/232

* cited by examiner

*Primary Examiner*—Carl D. Friedman
*Assistant Examiner*—Yvonne M. Horton
(74) *Attorney, Agent, or Firm*—Clifford G. Frayne

(57) ABSTRACT

An elongated C-shaped structural member for cooperation with the inner wall or partition and ceiling of a structure to confine a fire and prevent its spreading, the C-shaped structural member having an intumescent thermal gasket positioned on its outer vertical web face, and parallel extending flanges on its opposing web face, the upper extending flange having a plurality of finger members formed on its surface, the finger members displaceable to a plane vertical to the upper flange member for extension into the troughs of the underside of the ceiling, the C-shaped structural member secured to the ceiling by the upper flange member such that the intumescent thermal gasket is juxtaposed adjacent the upper outer surface of the interior wall or partition, the C-shaped structural member, upstanding finger members and the troughs associated therewith being encapsulated with a fire retardant cementious composition.

11 Claims, 4 Drawing Sheets

10
37
24
26
32
28
36
20
19
18
30
34
33
12
22
14
16

SLIP JOINT AND HOSE STREAM DEFLECTOR ASSEMBLY

This application claims benefit of provisional Application No. 60/105,733 filed Oct. 26, 1998.

BACKGROUND OF INVENTION

1. Field of Invention

This invention relates to wall and partition construction with either load bearing or non-load bearing wall design criteria in single or multi-story buildings where there is a need to confine a fire and prevent its spreading.

2. Description of the Prior Art

In normal building construction, particularly of the multi-story type, and more particularly in such construction where corrugated metal with or without concrete are formed into slabs and decks to form successive floors and/or roof assemblies. There is a physical condition and design criteria that floor slabs and/or roof decks must follow which allows for deflection or "sag", due to the passage of time or as a reaction to specific live loads, dead loads, or some other catastrophic building movement i.e. earthquakes, wind, fire, etc. In the construction of such buildings, partitions are designed and installed, in general practice, to either withstand these forces or to accommodate the anticipated movement. These partitions may be comprised of gypsum lath and plaster, wallboard with metal or wood framing, masonry units of various sizes, concrete, and a host of other material including but not limited to cement boards, fiber boards, and other well-known materials. Variability in the deflection or "sag" of the concrete ceiling or floor construction creates unique problems in the installation of partitions. Problems relating specifically to the vertical movement of the slab deflection and specifically to the partition construction have been addressed in prior art. However, there is a problem which remains with these walls or partitions as to their ability to insure the integrity of their specified fire rating or fire resistancy in accordance with national and local fire codes.

In the construction industry this is a particularly difficult and time consuming detail in the construction of the fire rated partitions or walls required by code. Specifically wherein the underside of the ceiling or floor are usually comprised of a corrugated or preformed metal substrate over which the concrete is poured in a manner to form the successive floors and/or concomitant ceilings of a one story or multi-story building, or wherein the underside of the ceiling or roof comprises a corrugated or preformed metal substrate over which insulation and roofing materials are placed in such a manner to form a roof assembly. The non-load bearing interior walls are oftentimes running perpendicular to the corrugations and/or fluted substrate which forms the ceiling and thus presents a wall/ceiling joint having a plurality of apertures therethrough at the intersecting line. In other situations the non-load bearing interior wall may find itself running directly parallel or partially offset of parallel to the corrugated substrate such that there may in fact be a longitudinal gap between the top of the non-load bearing wall and the undersurface of the ceiling. Thirdly, the partitions in some instances may run oblique to the direction of the corrugations and/or flutes creating a plurality of apertures therethrough at the intersecting line each having its own unique size, shape, and depth.

Fire rated walls, by code and definition, are required to maintain their specified rating from the base of the floor to the underside of the deck or ceiling above. The deck as stated, comes in various sizes and oftentimes irregular shapes. The current performance criteria for a fire rated wall is found in UL Test Procedure 2079 which establishes minimal performance requirements for this design condition. The test procedure is designed to provide evidence of minimal performance in the following areas.

The first test is commonly referred to as cycling. This test is designed to simulate the movement that a building experiences through settling, temperature expansion and contraction, normal occupancy vibrations and possibly vibration of a construction origin. Specifically it calls for a vertical cycling movement of one half inch at ten cycles per minute for fifty minutes.

The second minimal performance requirement is that of temperature. This test is designed to simulate the expected temperature potential of a fire condition. Specifically it calls for a hot side of approximately 1,850° F. with a cool side maximum temperature increase of 250° above ambient for a period of two hours.

The third test requirement is referred to as hose stream. This test is designed to give a measure of the toughness of the fire flashing by simulating the effects of a water bath somewhat akin to that of a fireman's hose stream. Specifically the test calls for a two inch stream of water at 125 pounds of pressure at 30 feet for a second and a half per square foot of sample. To meet this test, the assembly must pass all three requirements.

In the past, attempting to fireproof the intersection of a non-load bearing ceiling wall and the ceiling above it, which might be of irregular shape, required individuals to move along the wall ceiling intersection from point to point and hand fill any of the apertures or openings which might be present with a fiber packing of 4 to 8 pounds density and then cover each side of the packing with a special fire caulk. This was not only time consuming and costly, but also did not always result in a uniform fill which would meet the criteria of the aforementioned test.

Applicant has developed a structural member and assembly which meets the aforesaid test criteria, is easily installed and would significantly reduces labor and installation costs, and has built in quality control points.

OBJECTS OF THE INVENTION

An object of the present invention is to provide for a novel structural member and assembly for interior walls or partitions on multi-story buildings which is reactive to the normal settling, temperature expansion and contraction and occupancy vibrations of such building without diminishing its fire grading capacity.

Another object of the present invention is to provide for a novel structural member and assembly which is fire resistant and as such, capable of isolating smoke and fire and preventing its spread.

A still further object of the present invention is to provide for a novel structural member and assembly which is resistant to the effects of direct pressure from a hose stream.

A still further object of the present invention is provide for a novel structural member and assembly which can be quickly installed and thus decrease time and labor costs.

A still further object of the present invention is to provide for a structural member and assembly which incorporates quality control points to insure proper installation.

SUMMARY OF THE INVENTION

An elongated C-shaped structural member having an intumescent thermal gasket positioned on its outer vertical face, and a plurality of positionable upstanding finger members on its upper horizontal face protrudable into the void of the deck above, the vertical face being juxtaposed against the wall or partition face, with the C-shaped channel member optionally secured to a transverse elongate structural member secured to the underside of the ceiling, the C-shaped structural member and upstanding fingers and void in the ceiling being encapsulated in a cementitious material.

BRIEF DESCRIPTION OF THE DRAWINGS

These and other objects of the present invention will become apparent particularly when taken in light of the following illustrations wherein.

DETAILED DESCRIPTION OF THE DRAWINGS

Figures 1, 1A:
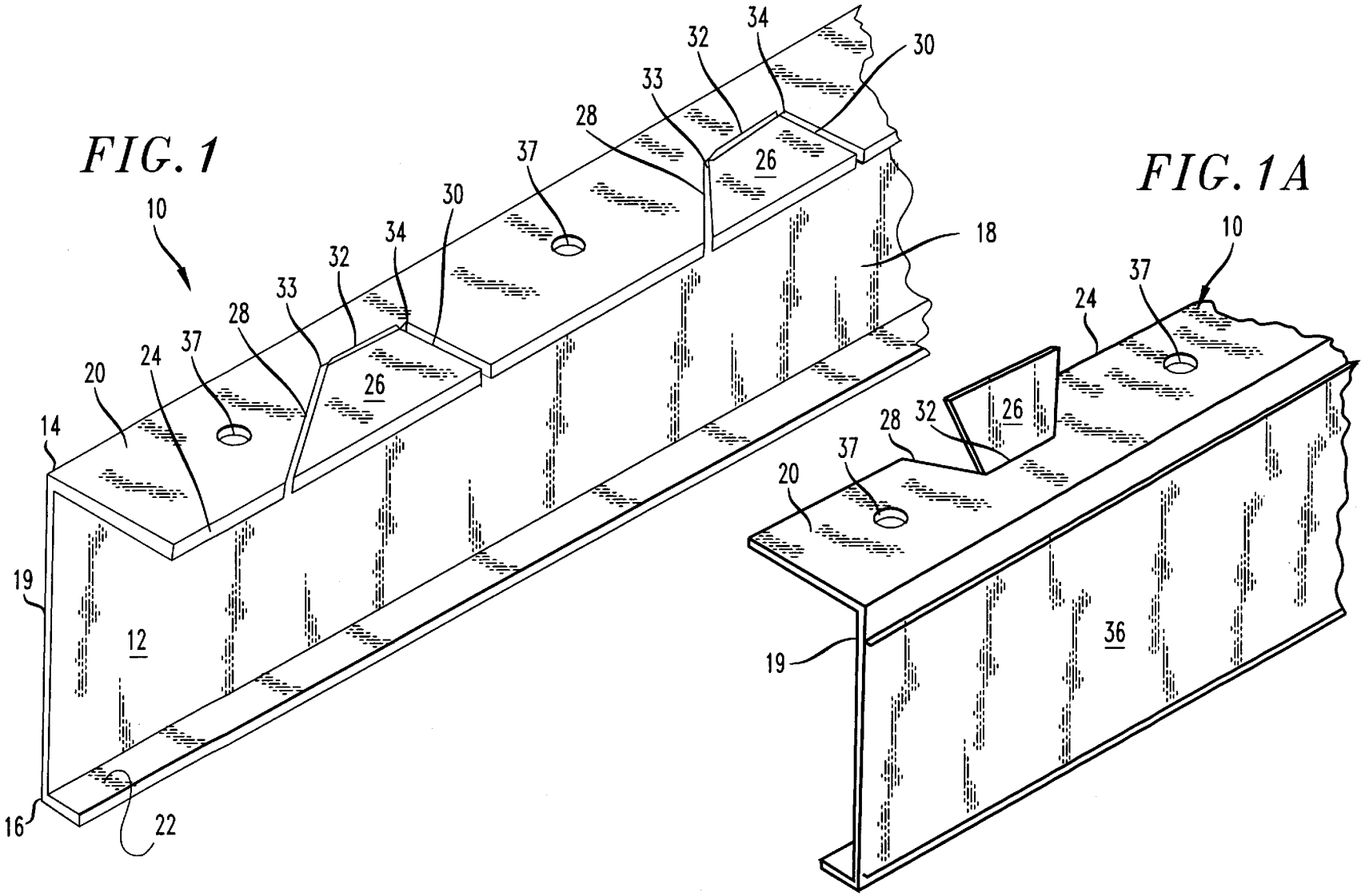
FIG. 1 is a front partial perspective view of the structural member.
FIG. 1A is a rear partial perspective view of the structural member.

FIG. 1 is a perspective view of the structural member 10, the subject matter of this patent application. Structural member 10 is generally C-shaped in cross-section having a vertical web member 12, having longitudinal edges 14 and 16 and first side 18 and second side 19. Depending outwardly from longitudinal edges 14 and 16 of first side 18 of web 12 are two flanges, an upper horizontal flange 20 and a lower horizontal flange 22. Flanges 20 and 22 are preferably parallel to each other and form a 90 degree angle with web 12. Upper horizontal flange 20 terminates with a longitudinal edge 24.

There is formed an upper horizontal flange 20, a plurality of spaced-apart displacable finger members 26. Finger members 26 are formed in the manufacturing process of structural member 10 and each are formed by two cuts commencing along longitudinal edge 24 and extending into the web of flange 20. The cuts 28 and 30 terminate at an equal distance into the web of flange 20 and the terminus points 33 and 34 of cuts 28 and 30 are connected by a perforated or embossed bend line 32. As illustrated in FIG. 1A, the perforated or embossed bend line 32 allows the finger members 26 to be rotated and bent upwardly along the perforated or embossed bend line 32 so as to be substantially vertical to the web of flange 20.

In the preferable embodiment, the web 12 of C-shaped structural member 10 would be two and a half inches in width, the web of upper horizontal flange 20 would be one inch in width and the web of lower horizontal flange 22 would be one quarter inch in width. The finger members 26 would repeat themselves in two inch cycles with seven eights of an inch gap between cuts 28 and 30 of adjacent finger members 26. Structural member 10 would be fabricated in lengths suitable for their application (i.e. 8 ft to 12 ft). Upper horizontal flange 20 and lower horizontal flange 22 are dimensioned to serve as quality control points with the application of cementious material as described hereafter. A visual inspection to insure their encapsulation is indicative that the wall or partition has been properly fire proofed.

In the embodiment illustrated in FIG. 1, the cuts 28 and 30 commence on longitudinal edge 24 of upper horizontal flange 20 and are convergent in nature terminating at perforated or embossed bend line 32 thus providing the resultant upstanding finger members 26 resembling an inverted truncated triangle. Preferably the height of finger members 26 when bent to the upstanding vertical position would be five eights of an inch. While the finger members 26 have been shown in the preferred embodiment in FIG. 1, their shape may vary from that shown, the only limitation being the void into which they are fit in the decking ribs as described hereafter. In addition, there may be preformed on the web of upper horizontal flange 20, a plurality of apertures 37 for receipt of a fastening means. FIG. 1A illustrates the second side 19 of web 12 of C-shaped structural member 10 secured thereto an intumescent thermal gasket 36 which is preferably preapplied in the manufacturing process and will become evident when considering the following figures.

Figure 2:
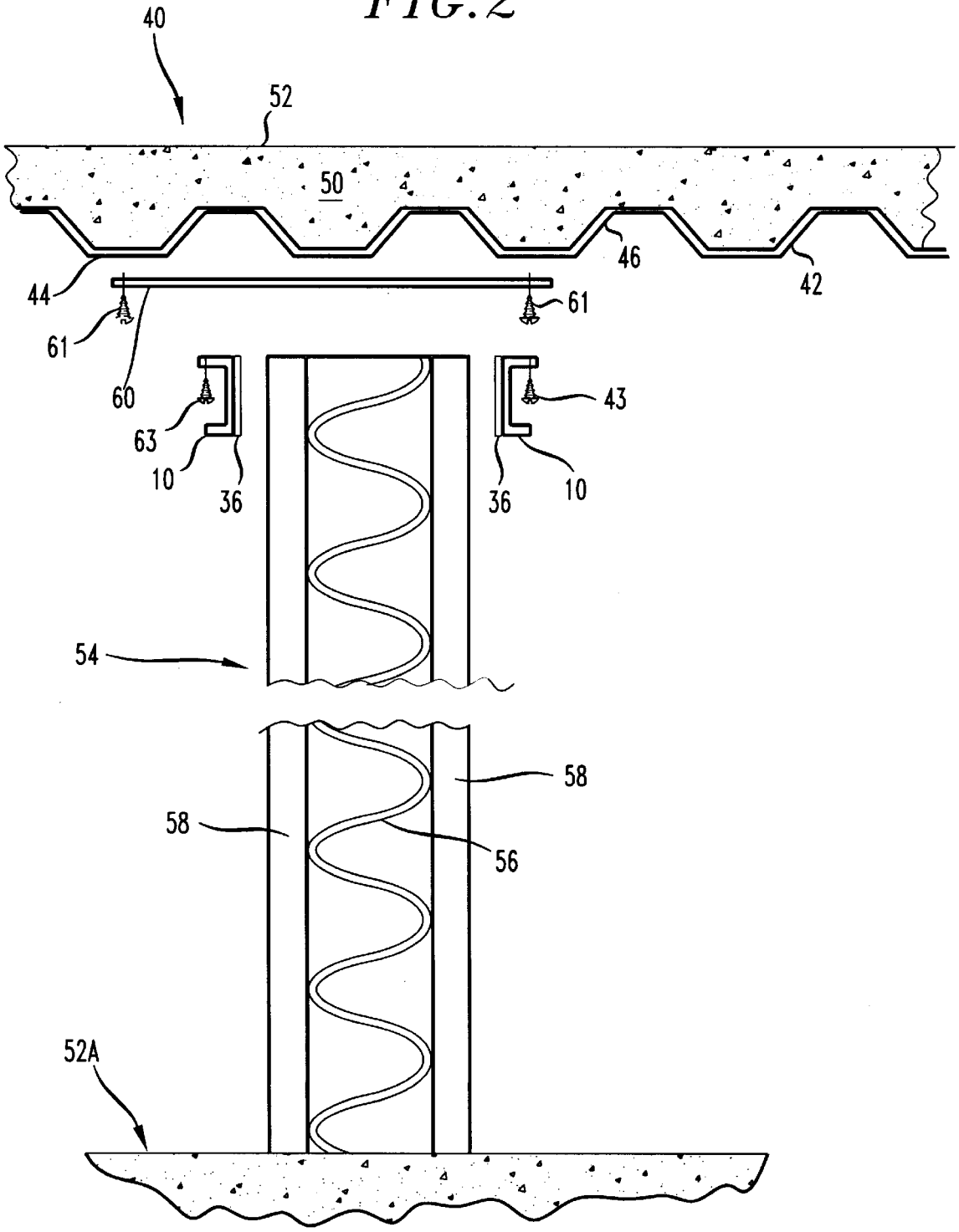
FIG. 2 is an exploded end view of the structural member with interior wall positioned parallel to the decking ribs.

FIG. 2 is an exploded view of the structural member 10 in conjunction with a wall or partition which is installed parallel to the decking ribs of the ceiling. In a typical construction, ceiling 40 is comprised of a metal decking element 42 normally fabricated from steel. Decking element 42 is formed in a corrugated nature having a repeating pattern of crests 44 and troughs 46. Decking member 42 is normally secured to the vertical and horizontal support members (not shown) of the structural frame. Decking member 42 would be overlaid with the cement or concrete 50 so as to form the floor 52 of the next successive story of the structure or in a single structure building, such a floor would actually be the roof.

The interior wall or partition 54 of the structure would extend from such a floor surface 52A up to the underside of the next successive floor surface 52. In many instances, the interior walls or partitions 54 would be positioned such that they ran parallel with repeating crests and troughs 44 and 46 respectively of metal decking member 42. This is the situation illustrated in FIG. 2 wherein an interior wall or partition 54 extends from lower floor surface 52A proximate to metal decking member 42. The interior wall or partition is comprised of an internal structural support 56 having overlaid on both sides thereof, a wall surface 58 comprised of a composition which meets the necessary national and local fire codes such as gypsum board or the like. It can be seen from FIG. 2, that the interior wall or partition 54 may straddle a crest 44 of metal decking member 42 and thus provide for a pathway for smoke and fire to travel from one side of interior wall or partition 54 to the opposing side. Applicant's structural member 10 provides for an easy and economical way for the contractor to block this passageway and prevent such spread of fire and smoke in accordance with the applicable fire codes.

In FIG. 2, there would be positioned on both sides of interior wall or partition 40, a structural member 10 in accordance with Applicant's teachings. The structural member 10 would be positioned with the intumescent gasket 36 juxtaposed against the outer surface 58 of partition 54. Since wall or partition 54 extends across a trough 44 of metal decking member 42, a transverse member 60 must be secured with a mechanical fastener 61 to the crests 44 of metal decking member 42. With transverse member 60 installed, the structural member 10 of Applicant's invention can then be juxtaposed against the outer surfaces 58 of wall or partition 54 and secured to transverse member 60 by a plurality of threaded mechanical fasteners 63 extending through apertures 37. Transverse member 60 is a planar member of such thickness and width and length so as to span the necessary troughs 44 so as to permit structural member 10 to be secured thereto.

Finger members 26 would be rotatably positioned upwardly perpendicular to upper horizontal flange 20 of structural member 10 so as to extend into the trough areas 46 proximate the outer surfaces of wall or partition 54. Finger members 26 may be so rotated either before or after installation depending upon the proximity of the crests 44. In this regard it can be seen that transverse member 60 is secured to metal decking member 42 and structural member 10 is secured to transverse member 60 such that both are free to move with any sag or deflection of the ceiling member 40. Despite such deflection or sag, intumescent gasket member 36 remains in close juxtaposed contact with the upper outer surface 58 of both sides of wall or partition 54.

Figure 3:
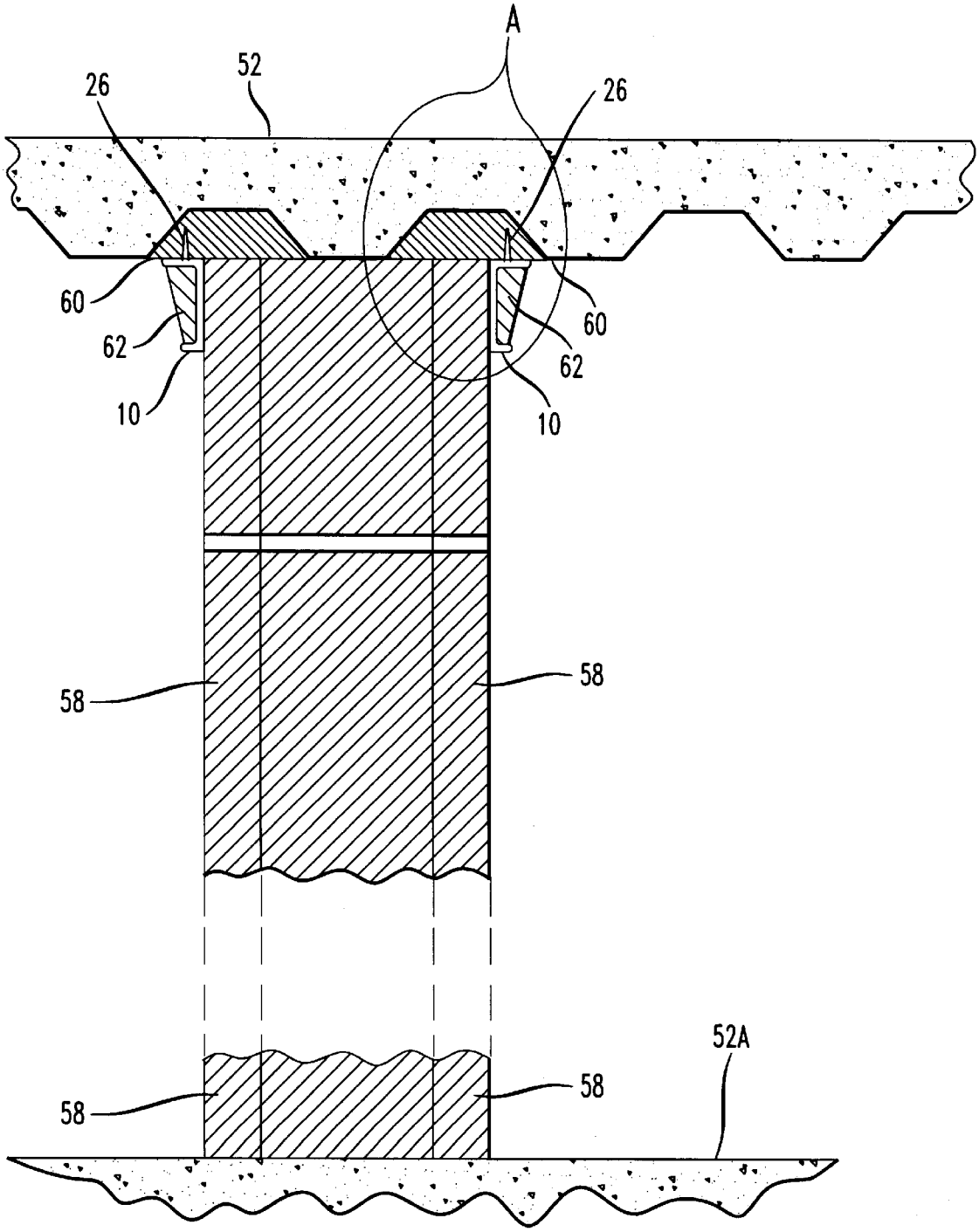
FIG. 3 is an end view of the structural member and interior wall secured parallel to the decking ribs.

FIG. 3 is an end view of the structural member and interior wall of FIG. 2 in a secured position. Once the structural member 10, wall or partition 54 have been positioned and structural member 10 has been secured to transverse member 60, a fireproof cementious composition 62 is spray applied on both sides of wall or partition 54 such that structural member 10 is encapsulated in such cementious spray 62 and that all or a portion of the trough areas 46 on both sides of wall or partition 54 are filled with such cementious spray 62. The cementious spray 62 may be readily applied by the contractor in a quick and easy fashion without the necessity of having a contractor specifically hand fill the void trough areas. The cementious spray 62 is applied from both sides of wall or partition 54 to insure that the fire code requirements heretofore set forth will be met after cementious material 62 has set. A suitable cementious material has been found to be Carboline Pyrocrete 239.

Figure 4:
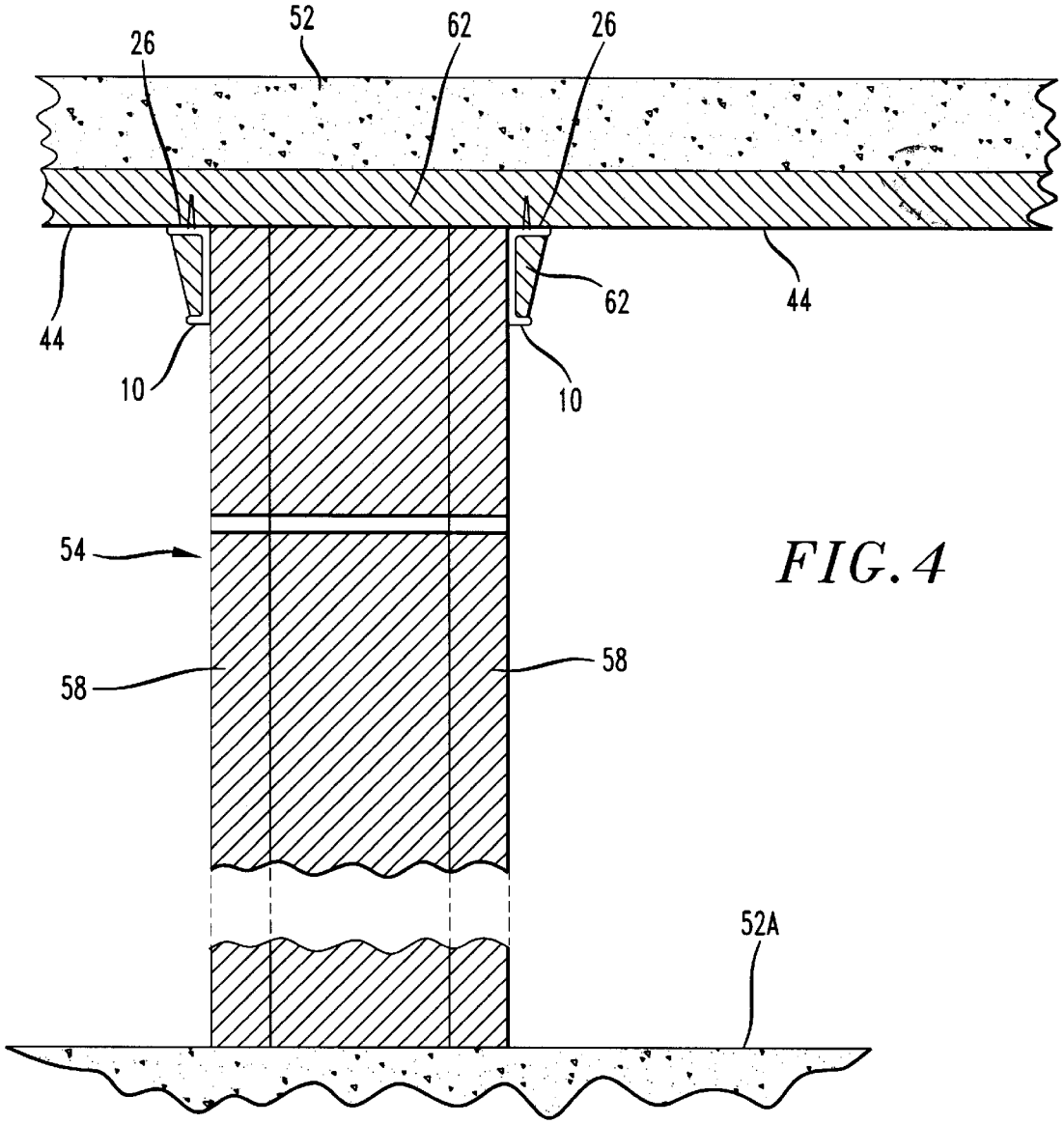
FIG. 4 is an end view of the structural member with interior wall secured perpendicular to the decking ribs.

Referring to FIG. 4 there is disclosed an interior wall or partition 54 which is installed perpendicular to the crests 44 and troughs 46 of decking member 42. In this particularly type of installation, transverse member 60 is not required. The construction proceeds in a similar manner as when the interior wall or partition 54 is installed parallel with the crests 44 and troughs 46 of decking member 42. Structural member 10 and intumescent gasket 36 are positioned such that intumescent gasket 36 is juxtaposed against the outer surface 58 of interior wall or partition 54. In this instance, metal fasteners 63 are utilized to secure structural member 10 directly into the surface of the crest member 44 of decking member 42. Finger members 26 may then be rotated upwardly into the void of the respective troughs which the structural member 10 encounters as it runs perpendicular to the crests 44 and troughs 46 of metal decking member 42. Thereafter, the cementious spray material 62 is utilized to encapsulate structural members 10 and the void areas in the troughs 46 and simultaneously encapsulating upstanding finger members 26.

Figure 5:
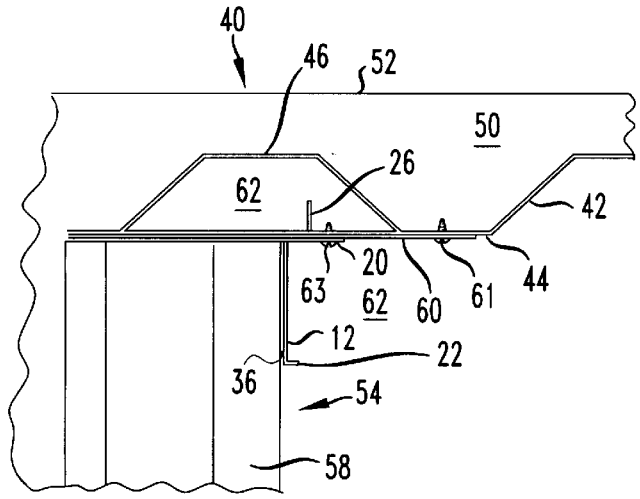
FIG. 5 is a close up view of area A of FIG. 3.

FIG. 5 is a close up view of area A of FIG. 3 so as to better provide an understanding of the manner in which the structural member cooperates with the interior wall or partition 54 and the transverse member 60 and decking member 42.

FIG. 5 illustrates the fact that the interior wall 54 is not flush with the ceiling, but presents a slight gap to accommodate the sag or deflection of the ceiling/floor above. Structural member 10 is secured to transverse member 60 and the cementious spray material 62 is sprayed into trough 46 and also encapsulates structural member 10. Upper horizontal flange 20 and lower horizontal flange 22 serve as quality control guides for the installation of the cementious spray material 62. In other words the cementious spray material 62 should completely cover upper flange 20 and have a depth proximate lower flange 22 equal to the depths of lower flange 22.

Structural member 10 has been illustrated with respect to an interior wall or partition running parallel or perpendicular to the crests and troughs of the ceiling. Structural member 10 would also have application in those instances where the interior wall or partition ran or was positioned at an angle to the crests and troughs of the ceiling. In that instance, structural member 10 may be secured directly to the crests of the ceiling member or in some instances, secured to transverse member 60 depending upon the angle of intersection. Finger members 26 would be disposed vertically to upper flange 20 into the intersected trough areas and the cementious spray material would be applied in a manner identical to that described with respect to a wall or partition running parallel or perpendicular to the crest and trough members.

While the present invention has been described with respect to the exemplary embodiments thereof, it will be recognized by those of ordinary skill in the art that many additions and modifications can be made without departing from the spirit and scope of the invention. Therefore it is manifestly intended that the invention be limited only by the claims and the equivalence thereof.

I claim:

1. A structural member cooperative with internal walls and partitions of a building and corrugated decking member of a ceiling having alternating crests and troughs to prevent the spread of fire across said internal walls or said partitions and yet allow for deflection of said ceiling under load, said structural member comprising:

an elongate C-sectioned member having a web portion having a first side and a second side;

a first longitudinal flange member extending from said first side of said web member;

a second flange member extending from said first side of said web member and parallel to said first flange member;

a plurality of finger members formed in said first flange member said finger members displaceable from the plane of said first flange member to a plane perpendicular to said first flange member and adapted to extend into alternating troughs of said corrugated ceiling member;

an intumescent gasket positioned on said second side of said web member of said structural member; and fastening means for securing said structural member to said ceiling.

2. The structural member in accordance with claim 1 wherein each of said plurality of finger members are formed on said first flange of said structural member by means of a pair of cuts extending from the longitudinal edge of said flange member toward said web member and terminating in an embossed bend line extending between the terminus of said cuts.

3. The structural member in accordance with claim 1 wherein said structural member is adapted to be secured to said corrugated decking member of said ceiling.

4. The structural member in accordance with claim 1 wherein said structural member is adapted to be positioned on both sides of said interior wall or partition.

5. The structural member in accordance with claim 2 wherein said structural member and said finger members after installation are adapted to be encapsulated in a fire retardant cementious composition.

6. An improved fire resistant internal wall or partition of a building which prevents the spread of fire across said internal wall or partition, yet allows for deflection of said ceiling under load, said improved fire resistant wall comprising:

a floor;

a ceiling comprised of a corrugated decking member having a plurality of alternating crests and troughs;

an internal wall or partition having an internal frame and overlaid with a fire resistant panel board, said internal wall or partition extending from said floor to said corrugated decking member;

an elongate C-sectioned member having a web portion having a first side and a second side, said elongate C-section member having a first longitudinal flange member extending from said first side of said web member and a second longitudinal flange member extending from said first side of said web member and parallel to said first flange member, said first flange member having a plurality of finger members formed on said first flange member said finger members displaceable from the plane of said first flange member to a plane perpendicular to said first flange member, said second side of said web member having an intumescent gasket positioned thereon, said elongate C-section member positioned proximate said upper portion of said internal wall or partition such that said intumescent gasket is in juxtaposed position with said wall, said first longitudinal flange member secured to said corrugated decking member, said plurality of finger members rotatable from said plane of said first flange member to said plane perpendicular to said first flange member and extending into said trough members of said corrugated decking member;

a fire retardant cementious composition encapsulating said elongate C-sectioned member and said finger members and said intersecting trough portion of said corrugated decking member.

7. The improved fire resistant internal wall or partition in accordance with claim 6 wherein said elongate C-sectioned member is positioned on both sides of said internal wall or partition.

8. The improved fire resistant internal wall or partition in accordance with claim 6 wherein each of said plurality of finger members are formed on said first flange of said structural member by means of a pair of cuts extending from said longitudinal edge of said flange member toward said web member and terminating in an embossed beaded hinge extending between the terminus of said cuts.

9. The method of installing a fire retardant internal wall in accordance with claim 7 wherein said encapsulating of said C-section member is accomplished by spraying said fire retardant cementious composition over said C-section member, said upstanding finger member and said trough of said corrugated decking member.

10. A method of installing a fire retardant internal wall or partition in a building wherein a ceiling comprises a corrugated decking member having a plurality of alternating crests and troughs, said method preventing the spread of fire across an internal wall or partition and yet allowing for the normal deflection of said ceiling under load, said method comprising:

(a) installing said internal wall and partition between a floor and said corrugated decking member of said ceiling;

(b) positioning an elongate C-section member proximate an upper portion of said internal wall or partition, said elongate C-section member having a web portion having a first side and a second side, said elongate C-section member having a first longitudinal flange member extending from said first side of said web member, a second longitudinal flange member extending from said first side of said web member and parallel to said first flange member, a plurality of finger members formed on said first flange members said finger members displaceable from said plane of said first flange member to a plane perpendicular to said first flange member, said structural member having an intumescent gasket positioned on said second side of said web member;

(c) positioning said intumescent gasket of said elongate C-section member adjacent said upper portion of said internal wall or partition;

(d) securing said first flange member to said corrugated decking member;

(e) rotatably positioning said finger members perpendicular to said first flange member and into said trough of said corrugated decking member;

(f) repeating steps b through e on said opposing side of said interior wall or partition; and (g) encapsulating said C-sectioned member and said upstanding finger member with a fire retardant cementious composition.

11. The method of installing a fire retardant internal wall or partition in accordance with claim 10 wherein said fire retardant cementious composition encapsulates said C-section member to a depth at least equal to the depth of said first longitudinal flange member and said second longitudinal flange member.

* * * * *